United States Patent [19]

Ables

[11] 3,999,225

[45] Dec. 28, 1976

[54] VENTILATED TOILETS

[76] Inventor: Eugene O. Ables, 1200 Lower Silver Lake Road, Topeka, Kans. 66608

[22] Filed: June 25, 1975

[21] Appl. No.: 590,301

[52] U.S. Cl. ..... 4/213; 4/217

[51] Int. Cl.[2] ..... E03D 9/04; A47K 13/00

[58] Field of Search ..... 4/217, 213, 209, 1

[56] References Cited

UNITED STATES PATENTS

| | | | |
|---|---|---|---|
| 2,849,727 | 9/1958 | Bollinger et al. | 4/217 |
| 3,857,119 | 12/1974 | Hunnicutt | 4/217 |
| 3,916,459 | 11/1975 | Ivancevic | 4/213 |
| 3,938,201 | 2/1976 | McGrew | 4/213 |
| 3,942,200 | 3/1976 | Pearson | 4/213 |
| 3,953,901 | 5/1976 | Poister | 4/213 |

*Primary Examiner*—Robert I. Smith
*Attorney, Agent, or Firm*—Thomas M. Scofield

[57] ABSTRACT

Improvements in ventilated toilets; means of and methods for exhausting fouled air from the interior zone of a toilet bowl in an enclosed bathroom zone and further removing said exhausted air from the latter; means for disinfecting and deodorizing the air drawn from the said toilet and bathroom as well as the ventilated portions of the toilet fixtures.

8 Claims, 3 Drawing Figures

VENTILATED TOILETS

BACKGROUND OF THE INVENTION

From the below listed prior art patents, it is evident that the concept of exhausting air from toilet bowls is ancient in the art. The desirability of exhausted fouled air from a toilet bowl to a conduit to the space exterior of the toilet facility or bathroom is self-evident and the basis of the prior art developments with respect to same. However, there are numerous draw-backs to the prior art systems.

Most of the known devices draw air from the interior of the toilet bowl through the underside of the seat, attachments to the underside of the seat or even through openings in the underside of the rim of the bowl. Prior art machines accomplish this, but they accentuate present problems of cleaning and disinfecting the appurtenances of a water closet, including the bowl and the seat. The forcible withdrawal of a fouled air from the interior space of the bowl through the rim of the bowl itself or the seat creates additional cleaning problems, particularly within the bowl rim and the seat proper, as well as disinfecting problems.

Another problem common to the prior art of which I am aware lies in the fact that the foul and odoriferous air which is removed from the toilet bowl and the bathroom environment is transferred merely to another location, without any change in its character or nature. Specifically, this removed air is not deordorized or disinfected or both. In the case of an isolated house situated, for example, on a multi-acre tract of land with no adjacent dwellings, this is no problem. However, this is not the typical situation and where the ventilated toilet or toilets are in a hotel or a motel unit or in houses closely situated with respect to one another, the forcible venting of such gases can be highly objectionable to the exterior environment. Yet further, it should be understood that current plumbing codes do not permit the exhuast from a ventilated toilet to be passed into the plumbing vent.

THE PRIOR ART

I am aware of the following U.S. patents directed to devices for ventilating water closets and toilet bowls:

Swarzman U.S. Pat. No. 1,247,176, issued Nov. 20, 1917, for "Toilet Ventilator";

Cameron U.S. Pat. No. 1,622,993, issued Mar. 29, 1927, for "Suction Device for Water Closets";

Minkler U.S. Pat. No. 1,911,032, issued May 23, 1933, for "Toilet Bowl Ventilator";

Miller, U.S. Pat. No. 2,610,328, issued Sept. 16, 1952, for "Ventilated Toilet Bowl";

Gudish U.S. Pat. No. 2,728,088, issued Dec. 27, 1955, for "Ventilated Seat and Cover Assembly for Toilet Bowls";

Bulow U.S. Pat. No. 2,824,313, issued Feb. 25, 1958, for "Electric Toilet Seat Exhaust Ventilator"; and Klemme U.S. Pat. No. 3,416,167, issued 12-17-68 for "Ventilated Toilet";

Maisch U.S. Pat. No. 3,599,253, issued 8-17-71 for "Toilet Fitting";

Smith U.S. Pat. 3,733,619, issued May 22, 1973, for "Ventilated Toilet"; and

Bendersky et al U.S. Pat. No. 3,790,970, issued 2-12-74 for "Toilet Stool Ventilating Means".

OBJECTS OF THE INVENTION

A first object of the instant invention is to markedly improve the toilet ventilating devices and systems of the prior art by correcting several of the problems which have remained inherent thereto.

Another object of the invention is to provide an efficient, effective, long-lived and dependable toilet bowl ventilating system which, in addition to removing the fouled air from the toilet bowl, simultaneously thoroughly deodorizes and disinfects this air.

Another object of the invention is to provide improvements in means and systems for ventilating toilet bowls which means and improvement continuously, in use, deodorize and disinfect the air being withdrawn from the toilet bowl, the toilet seat and the interior of the bowl.

Another object of the invention is to provide simple apparatus which may be associated with a ventilating toilet seat which will permit the continuous and effective deodorization and disinfection of the entire toilet bowl ventilating system and all the apparatus associated therewith, as well as all of the air exhausted from the toilet bowl.

Other and further objects of the invention will appear in the course of the following description thereof.

In the drawings, which form a part of the instant specification and are to be read in conjunction therewith, embodiments of the invention are shown and, in the various views, like numerals are employed to indicate to like parts.

DESCRIPTION OF STRUCTURE AND FUNCTION

Figure 2:
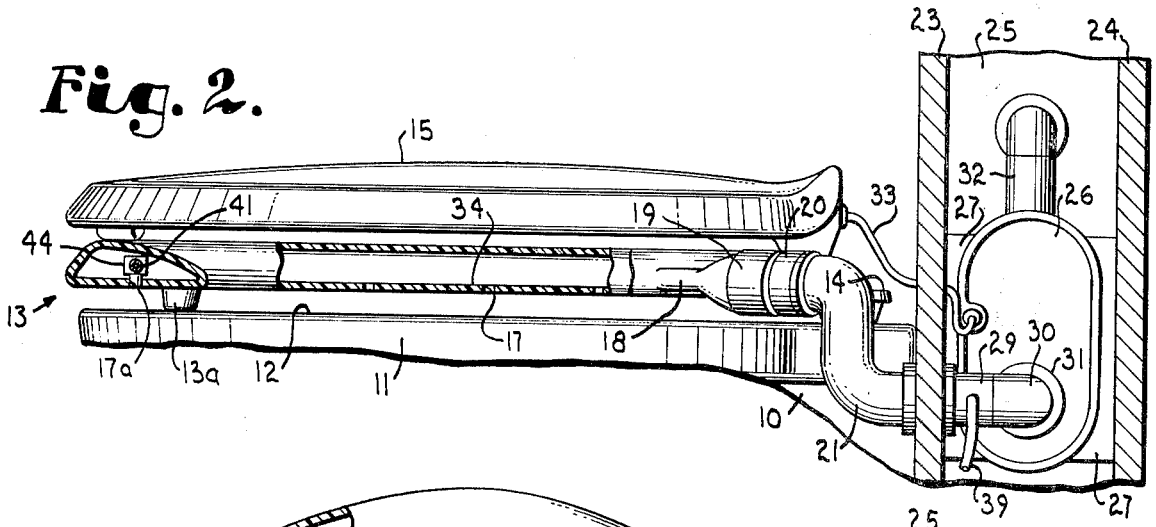
FIG. 2 is a side, partly sectional elevation of the top portion of a toilet bowl with associated seat and lid, same positioned next to a vertical wall within which the air pump and disinfectant and deordorant means are situated.
Figure 3:
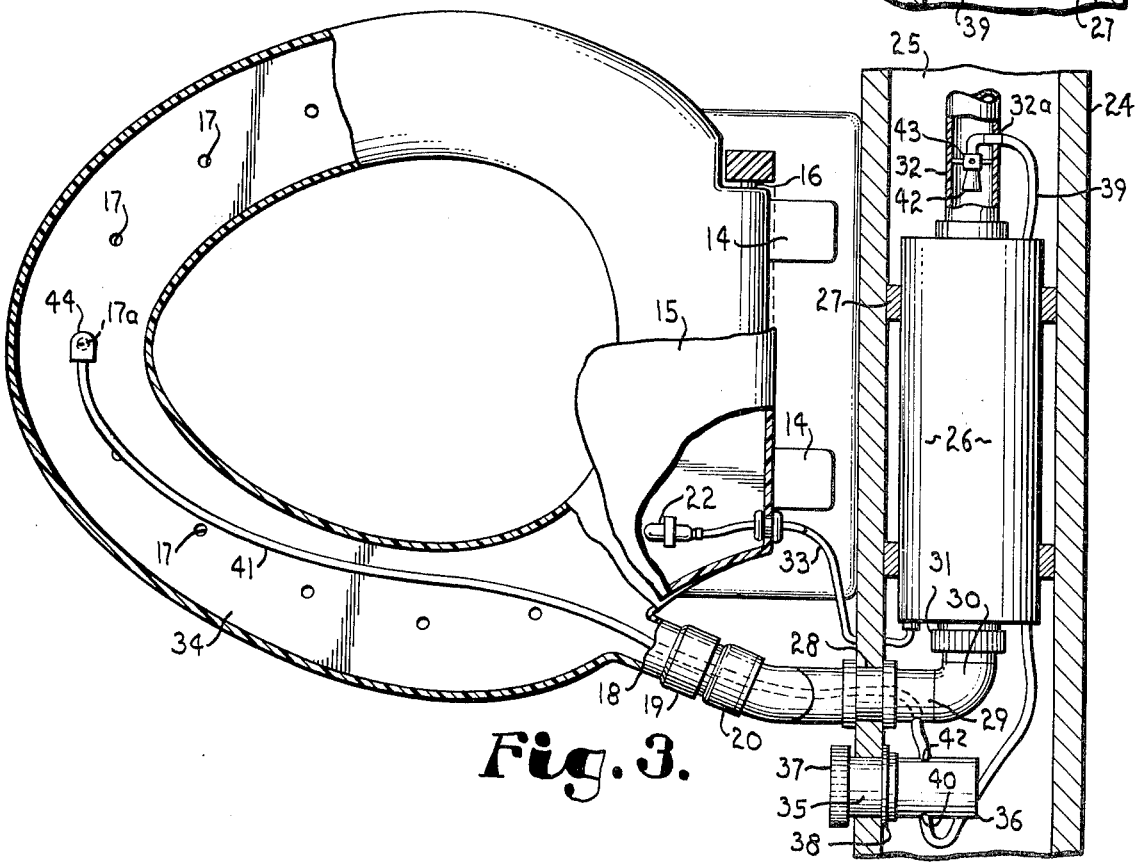
FIG. 3 is a top plan view of the apparatus seen in FIG. 2 with parts cut away to better illustrate the structure of the various devices and means employed in the practice of the instant invention.

Referring first to FIGS. 2 and 3, at 10 is seen a conventional toilet stool 10 which typically has a top or upper flanged portion 11 having a flat upper edge 12. The conventional and necessary apurtenances and fittings of a toilet are assumed present and conventionally coupled with this stool and will not be here described. A toilet seat generally designated 13 is pivotally connected to the stool or bowl 10 in conventional manner by brackets 14 or otherwise, whereby to pivot from the down position seen in FIGS. 2 and 3 to an up position slightly more than 90° clockwise from the position of FIG. 2. A conventional toilet lid 15 is pivotally mounted above seat 13, typically sharing a common hinge or hinge line with the seat 13. The shaft here mounting both the seat 13 and lid 15 with respect to brackets 14 is seen at 16 (FIG. 3).

All of the apparatus heretofore described is conventional, including the lugs 13*a* which are conventionally provided mounted on the underside of seat 13 to space same upwardly somewhat from the upper flange 11 of stool 10.

Toilet seat 13 is hollow, as may be seen in FIGS. 2 and 3 and has a plurality of evenly spaced small orifices or holes through the lowermost wall thereof as may be seen at 17. Holes 17 are preferably spaced substantially centered over the upper face 12 of rim 11 of stool 10 whereby to draw fouled air from the entire zone below and inboard of the seat 13. Additionally, a certain quantity of air is drawn from exterior of the toilet bowl and seat because of the position of the openings 17. A conduit 18 is provided on one side of the seat 13 adjacent the pivotal mounting thereof which opens into space 34 inside of the toilet seat. Conduit 18 may be provided with female fitting 19 which is adapted to removably receive male fitting 20 on flexible air conduit 21. Microswitch 22 is preferably mounted in lid 15 operative to function upon lifting of lid 15 from the position of FIG. 2. Optionally, a conventional flip or push switch may be provided, particularly if no lid 15 is present. Such other switch may be mounted on the wall of the room adjacent the toilet.

The toilet bowl 10 is shown as mounted next to a double wall configuration having panels or members 23 and 24 defining the double wall with air space 25 therebetween. Any conventional fan means of suitable capacity and force is provided at 26 mounted by members 27 in space 25. Conduit 21 passes through an opening in wall panel 23 at 28 where it is connected to suitable transition conduits and fittings 29, 30 and 31 on the intake side of fan 26. The output side of fan 26 discharges into housing the bathroom in which stool 10 is situated. A suitable electrical conduit 33 connects the motor of fan 26 (not seen) with microswitch 22 whereby, in the assembly seen in FIGS. 2 and 3, raising of lid 15 turns on the motor of fan 26. This action draws air from sapce 34 interiorly of seat 13 into conduit 18, through fittings 19 and 20, into conduit 21, thence through wall panel 23 at 28 and through fittings 28, 30 and 31 into the fan and therefrom out through discharge conduit 32. In short, the air inside the toilet bowl and in the immediate vicinity of the top rim 11 of stool 10 is drawn into the openings 17, through the fan 26 and passed outwardly of the bathroom to atmosphere.

In the event that a plurality of toilets in a dwelling or building employ the instant system, the discharge conduits 32 thereof may be ganged into a common discharge pipe to atmosphere. If the just described device and apparatus is operated, the fouled air in use of the toilet will be drawn through the openings 17 into the space 34 and through the conduits mentioned without any treating or change in the character thereof. This function, as previously stated, has numerous objections thereto which will not be again here repeated.

Accordingly, I have provided a critical improvement in systems such as have just been described wherein, in the process of exhausting fouled air from the interior zone of the toilet bowl positioned in an enclosed bathroom zone and removing the exhausted air from the enclosed bathroom zone, a portion of the exhausted air is charged with either or both of disinfecting and deodorizing chemical substances with the said charged air being recycled into the interior zone of the toilet bowl. This desirable improved process may be accomplished by very simple apparatus. Thus, there is provided in wall panel 23, in an opening 35 therethrough, a container 36 closed at the end in the space 25 and openable via cap 37 in the bathroom space. A positioning flange 38 may additionally be provided. Positioned within container 36 is a quantity of chemical substance in particle, pellet or cylindrical bar form comprising preferably at the very least, a powerful disinfectant. Additionally, and preferably, there if coupled therewith a quantity of deodorizing chemical. Replenishment after use is by removal of cap 37 in the bathroom zone.

An elongate, relatively small diameter, flexible yet shape retaining conduit or pipe 39 is provided which leads from the discharge conduit 32 frm fan or pump 26 into an opening 40 on container 36 in space 25. There is further provided a second elongate conduit 41 of like character communicating from a second opening 42 in container 36 in space 25 through fitting 29, passage 28, conduit 21, fittings 20 and 19 and into space 34 inside hollow toilet seat 13. This conduit preferably leads to the opening 17*a* which is centrally positioned at the outer or front portion of the seat away from the hinge pivot of the seat and lid. Conduit 39 penetrates an opening 32*a* in discharge conduit 32 and is connected to an intake nozzle 42 centrally positioned in duct 32 by a conventional spider 43. Conduit 39 may be passed back through the housing of the fan or pump 26 or may be secured along the outside thereof. At the opening 17*a*, conduit 41 has fitting 44 which receives the end of conduit 41 and passes at right angles thereto through opening 17*a*.

An operation of the entire device, including the disinfecting and deodorizing means just described, lifting of the lid 15 trips microswitch 22 energizing fan or blower 26. This starts two processes. The first process is the continuous withdrawal of air through openings 17 from the toilet bowl and the area immediately therearound into space 34 in the toilet seat and thence into conduit 18, etc. out discharge conduit 32. The second process involves the recycle of a portion of the air moving through discharge conduit 32 via intake nozzle 42, through conduit 39, through chemical containing container 36, into conduit 41 and out through opening 17*a*.

Since the fan or blower 26 is energized immediately the lid 15 goes up, immediate exhaust of air (ambient bathroom air) takes place driven by the fan 26. The recycle air rammed into nozzle 42 and thus through conduit 39, etc. picks up, immediately, a charge of at least disinfecting and preferably disinfecting and deodorizing chemical from container 36, same passing immediately into conduit 41 and being discharged from opening 17*a*. Thus, from the first discharge of air through fan 26 into discharge conduit 32 there is continuous recycle (so long as fan 26 is running) of air from that conduit back through container 36 and out of opening 17*a*. The point is that, as the stool is used, the air being drawn therefrom during use is partially disinfectant (and preferably also deodorizer) charged. Thus, there is no substantial quantity of fouled air drawn into space 34 through opening 17 that is not partially admixed with the disinfectant and deodorizing chemical carried in the recycle air stream. This additionally means that the air ultimately discharged from conduit 32 to the outside is, in effect, fully charged with disinfecting and deodorizing chemicals.

In this manner, the difficultires and problems attendant to the prior art devices noted above are obviated. Said otherwise, my improvement performs two basic functions. In the first place, it cleans, sterilizes and deodorizes the seat per se and the air discharge conduits associated therewith in use and over a period of time, continuously. Secondly, my improvement assures the deodorizing and at least some disinfection of all the air exhausted from the bathroom zone through discharge conduit 32. Still further, the entire stool zone, insofar as it is contacted by the air from opening 17*a* will be disinfected and deodorized.

Figure 1:
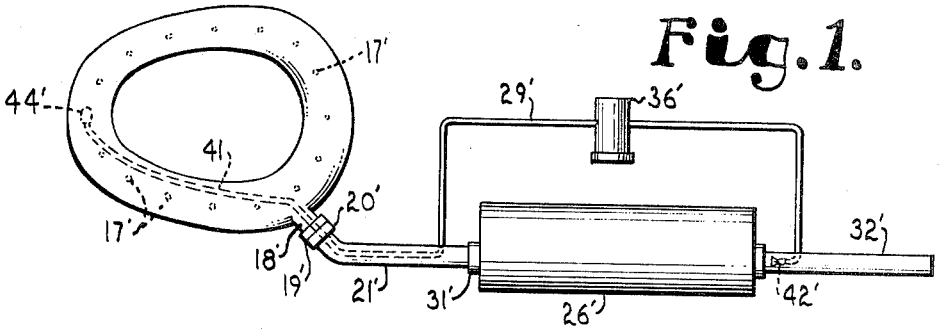
FIG. 1 is a schematic plan view from above of the subject system and apparatus for disinfecting and deodorizing a toilet bowl ventilating system and the air evacuated from the toilet bowl.

FIG. 1 is a vertical plan view from above of the apparatus of FIGS. 2 and 3 shown in schematic array. Like parts are indicated with like numerals, but primed, as compared with FIGS. 2 and 3.

With respect to the number, location and spacing of the holes 17 in the underside of the seat 13, in addition to the remarks already made, the following considerations adhere. Openings 17 may be provided in the portion of the underside of the seat closely adjacent the hinge, but such is not preferred. This is for the reason that, when the seat is pivoted upwardly from the position of FIGS. 2 and 3, in use, the absence of orifices 17 in that location minimizes contamination from splashing. Further, the positioning of the openings 17 over the rim 12 or slightly outboard thereof also minimizes splashing contamination when the seat is in the down position as in FIGS. 2 and 3. Still further, considering the use of the high velocity fan or air pump 26, when the seat is in the down position of FIGS. 2 and 3, the central opening of the seat is sealed off, or largely sealed off. Accordingly, most of the air which passes in through openings 17 actually comes from the zone outside the stool, only a limited quantity from within the confines of the stool.

It is most desired that the seat 13 be spaced upwardly from the rim 12 of the stool where a vacuum system as described is in use. As is well known, under certain clogging conditions, stools will overflow and it is not desired that the openings 17 or the interior space 34 of the seat 13 be fouled or contaminated, if at all possible.

The central positioning of recycle opening 17*a*, assuming a uniform, equal pattern of openings 17 on each side thereof, gives an equal draw into all the openings 17 of the recycle air carrying the deodorizing and disinfecting chemicals. With respect to the quantity of air recycled via line 39 out of fitting 17*a*, no more than 5% to 20% of the total air taken out through conduit 18 should be recycled, preferably in the lower portion of the range given. It is not desired to return sufficient air that the recycle air will be forced out of the bowl. As previously noted, the greater portion of the air in the intake openings 17 is going to come from outside of the bowl. The recycle is required only to deodorize and disinfect the interior of the bowl, per se, the underside of the seat and the air taken in through openings 17 from whence the air is confined in the withdrawal system, save for that again recycled via line 39.

In addition to the cake, pellet and powder forms of chemical previously described, it is feasible to employ a saturated wick carrying the desired chemicals in the container 36. Examples of usable deodorizing and disinfecting chemicals include Orthophenylphenol (0.08%) and Para Tertiary Amylphenol (0.02%). Another such composition comprises O-Phenylphenol (0.10%) and M-alkyl ($C_{18}$ 92%; $C_{16}$ 8%) - N-Ethyl Morpholinium Ethyl Sulfates (0.035%). These ingredients, in a wick application, may be combined with ethyl alcohol (typically 32–54%) and other inert ingredients.

A formulation usable with a conventional powder, cake or pellet carrier would comprise:

Methyldodecylbenzyl-Trimethyl Ammonium Chloride 0.400%;
3, 4′, 5 Tribromosalicylanilide 0.160%;
Melhyldodecylxylylene Bis (Trimethyl Ammonium Chloride) 0.100%;
5, 4′ Dibromosalicylanilide 0.040%;
Triisopropanolamine 2.750%;
Essential Oils 0.100%.

These are known commercial disinfectant and deodorant chemical formulations and are not peculiar or unique to this use. They are disclosed solely as usable and workable formulations in such application. Other formulations and compounds may be employed in the subject process and apparatus.

From the foregoing, it will be seen that this invention is one well adapted to attain all of the ends and objects hereinabove set forth together with other advantages which are obvious and which are inherent to the process.

It will be understood that certain process features, steps and sub-combinations thereof are of utility and may be employed without reference to other features, steps and process subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. In a process of continuously exhausting fouled air from the interior zone of a toilet bowl which is positioned in an enclosed bathroom zone and continuously removing said exhausted air from said enclosed bathroom zone in an enclosed conduit, the improvement which comprises:

continuously collecting a portion of said exhausted air from said conduit, continuously charging said portion of the exhausted air with a disinfectant chemical, and continuously recycling the said disinfectant chemical-charged air back into the interior zone of the toilet bowl, whereby, after the initial withdrawal of air from the toilet bowl interior zone, substantially all of the air withdrawn therefrom is disinfectant chemical charged.

2. In a process of continuously exhausting fouled air from the interior zone of a toilet bowl which is positioned in an enclosed bathroom zone and continuously removing said exhausted air from said enclosed bathroom zone in an enclosed conduit, the improvement which comprises:

continuously collecting a portion of said exhausted air from said conduit, continuously charging said portion of the exhausted air with disinfecting and deodorizing chemical substances and continuously recycling the said disinfecting and deodorizing chemical substance-charged air back into the interior zone of the toilet bowl, whereby, after the initial withdrawal of air from the toilet bowl interior zone, substantially all of the air withdrawn therefrom is chemical substance charged.

3. In combination with a toilet having a conventional stool and a pivotal seat associated with said stool, the toilet located in an enclosed bathroom area, means for continuously exhausting air from the zone interior of said stool through said seat to a zone exterior of the enclosed bathroom area through an enclosed conduit connected to said seat, means for continuously recycling a portion of the said exhausted air into the said stool interior zone from said conduit through said seat, and means for continuously charging said latter recycle air with a disinfectant treating chemical, before passing said recycle air into said stool interior zone, whereby, after the initial withdrawal of air from the stool interior zone, substantially all of the air withdrawn therefrom is disinfectant chemical charged.

4. Apparatus as in claim 3 wherein the treating chemical is a disinfectant.

5. Apparatus as in claim 3 wherein the treating chemical is a deodorant.

6. Apparatus as in claim 3 wherein the treating chemical includes both disinfectant and deodorant.

7. An apparatus for continuously exhausting fouled air from the interior zone of a toilet bowl positioned in an enclosed bathroom zone, continuously removing said exhausted air from said enclosed bathroom zone and further continuously chemically treating the said air with a disinfectant chemical before removing if from said zone comprising, in combination:

a toilet bowl positioned in an enclosed bathroom zone, a hollow toilet seat associated with said toilet bowl and having a plurality of spaced, intake openings penetrating the underside of said hollow seat, means for continuously drawing fouled air into the said hollow toilet seat, through said intake openings, from the interior zone of the toilet bowl and thereafter continuously exhausting said air out of said bathroom zone in an enclosed conduit connected to said seat, means for continuously recycling a portion of said exhausted air back into the interior zone of the toilet bowl from said conduit, and means for continuously charging said latter recycle air with a disinfectant chemical, before passing said recycle air into said interior zone of the toilet bowl, whereby, after the initial withdrawal of air from said toilet bowl interior zone, substantially all of the air drawn through said seat is chemically treated with a disinfectant.

8. Apparatus as in claim 7 wherein said air is recycled back through the said hollow toilet seat and out the underside thereof closely adjacent the interior zone of the toilet bowl.

* * * * *